US009056502B2

(12) United States Patent
Imamura

(10) Patent No.: US 9,056,502 B2
(45) Date of Patent: Jun. 16, 2015

(54) IMAGE RECORDING APPARATUS

(71) Applicant: SEIKO EPSON CORPORATION, Tokyo (JP)

(72) Inventor: Atsushi Imamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/333,826

(22) Filed: Jul. 17, 2014

(65) Prior Publication Data

US 2015/0077460 A1 Mar. 19, 2015

(30) Foreign Application Priority Data

Sep. 13, 2013 (JP) ..... 2013-190656

(51) Int. Cl.
*B41J 29/393* (2006.01)
*B41J 13/02* (2006.01)

(52) U.S. Cl.
CPC ..... *B41J 13/02* (2013.01)

(58) Field of Classification Search
CPC ..... B41J 29/393; B41J 2/125; B41J 11/0095; B41J 11/002; B41J 19/205; B41J 2/14153
See application file for complete search history.

(56) References Cited

U.S. PATENT DOCUMENTS

| | | | | |
|---|---|---|---|---|
| 6,435,641 | B1 * | 8/2002 | Tung et al. | 347/16 |
| 8,029,087 | B2 * | 10/2011 | Kusunoki | 347/19 |
| 8,720,333 | B2 * | 5/2014 | Henn et al. | 101/228 |
| 2013/0141486 | A1 | 6/2013 | Suzuki | |

FOREIGN PATENT DOCUMENTS

| | | | |
|---|---|---|---|
| JP | 2013-116788 | A | 6/2013 |
| JP | 2013-129062 | A | 7/2013 |

* cited by examiner

*Primary Examiner* — Lamson Nguyen
(74) *Attorney, Agent, or Firm* — Global IP Counselors, LLP

(57) ABSTRACT

An image recording apparatus includes a roller that is configured to rotate in a direction of conveyance of a recording medium in a state of contact with the recording medium, which is being conveyed, and that has a support shaft extending in a direction intersecting with the direction of conveyance, a fixation member fixing the roller movably in the direction intersecting with the direction of conveyance; a detector that is positioned between the roller and the fixation member and configured to detect a force received from the recording medium via the roller, a support member having an elastic member, and a roller movement unit that is connected to the support member and configured to move the roller in the direction intersecting with the direction of conveyance.

8 Claims, 8 Drawing Sheets

| LOAD (N) | DISPLACEMENT (mm) |
|---|---|
| 5 | 0.005 |
| 10 | 0.007 |
| 50 | 0.020 |
| 100 | 0.040 |
| 180 | 0.068 |

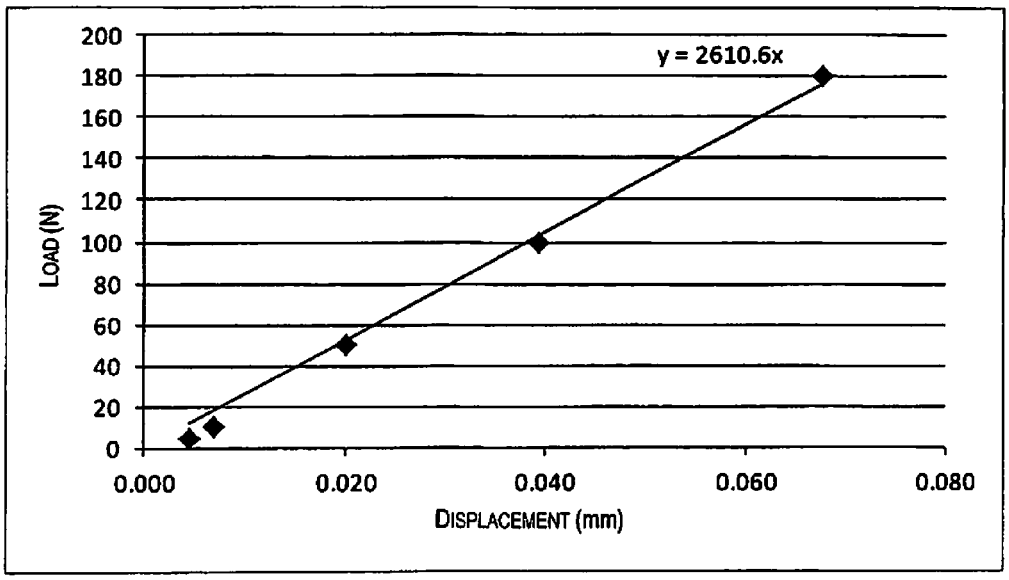
Fig. 8
| SPRING CONSTANT OF LEAF SPRING (N/mm) | LOAD DETECTION ERROR (%) | | |
|---|---|---|---|
| | LOAD 10N | LOAD 40N | LOAD 80N |
| 5.33 | 1.29 | 2.26 | 2.74 |
| 24.66 | 4.81 | 4.86 | 3.71 |
Fig. 9
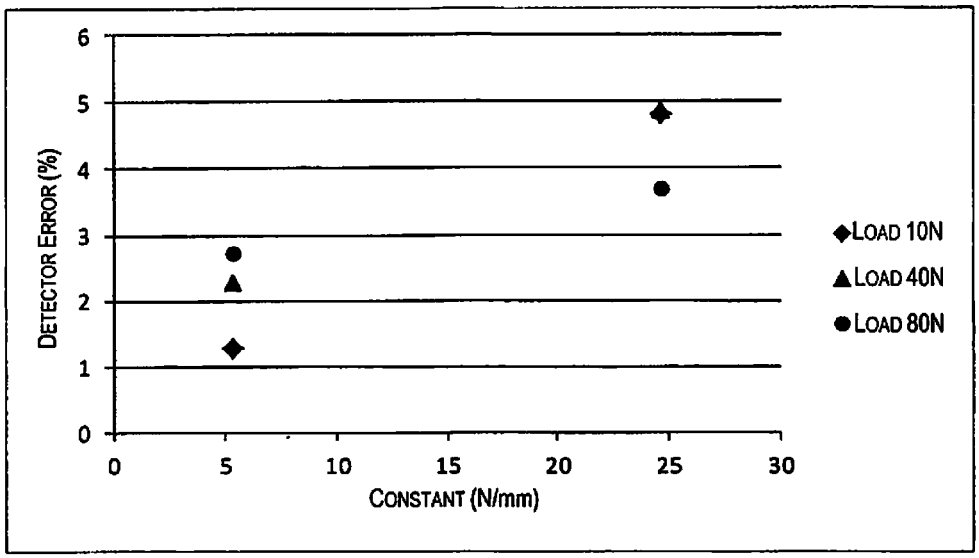
Fig. 10

IMAGE RECORDING APPARATUS

CROSS-REFERENCE TO RELATED APPLICATIONS

This application claims priority to Japanese Patent Application No. 2013-190656 filed on Sep. 13, 2013. The entire disclosure of Japanese Patent Application No. 2013-190656 is hereby incorporated herein by reference.

BACKGROUND

1. Technical Field

The present invention relates to an image recording apparatus for detecting the tension of a recording medium on the basis of a force received by a roller from the recording medium.

2. Related Art

An image recording apparatus in Japanese laid-open patent publication No. 2013-129062 is equipped with a configuration where a sheet that is wound up into the shape of a roll is supported with a roller that is provided between a feed-out spindle and a take-up spindle, while both ends of the sheet are also being supported at the feed-out spindle and the take-up spindle. In particular, with the image recording apparatus of such description, a driven roller around which the sheet, having been fed out from the feed-out spindle, is wound is responsible for a steering function for adjusting the position of the sheet in the axial direction of the feed-out spindle as well as a tension detection function for detecting the tension of the sheet. In other words, this driven roller is configured so as to be movable in the axial direction of the feed-out spindle, and adjusts the position of the sheet in the axial direction of the feed-out spindle by moving in the axial direction of the feed-out spindle in accordance with the position of detection of a sheet end. Attached to this driven roller is a tension sensor constituted of a load cell; by detecting the force received from the sheet, the tension sensor detects the tension of the sheet.

In order to use the tension sensor attached to the roller to accurately detect the tension of the sheet, as described above, it is important that the force received by the roller from the sheet be sufficiently transmitted to the tension sensor. To elaborate on the reason for this, the force transmitted to the tension sensor from the roller changes when there is a change in the force received from the sheet by the roller, in accordance with a change in tension of the sheet. Thus, the result of detection of the tension sensor is reflective of the change in tension of the sheet. As such, in order to accurately detect the tension of the sheet, it is important that the force received from the sheet by the roller be sufficiently transmitted to the tension sensor and be reflected well in the result of detection of the tension sensor.

However, a support member by which the roller by which the roller is driven in the axial direction while also being supported is in some instances separately provided in an image recording apparatus where the roller is moved in the axial direction with the aim of having the roller also fulfill a steering function or the like, as described above. Such an instance gives rise to the possibility that the force received by the roller from the sheet will be distributed to the support member and will not be sufficiently transmitted to the tension sensor, because the support member supports the roller against the force received from the sheet, thus making it impossible to accurately detect the tension of the sheet.

SUMMARY

The present invention has been made in view of the above problem, and an objective thereof is to provide an image recording apparatus which enables accurate detection of the tension of a recording medium on the basis of a force received by a roller from the recording medium.

A first mode of an image recording apparatus as in the invention, in order to solve the above-described objective, comprises: a roller that is configured to rotate in a direction of conveyance of a recording medium in a state of contact with the recording medium, which is being conveyed, and that has a support shaft extending in a direction intersecting with the direction of conveyance, a fixation member fixing the roller movably in the direction intersecting with the direction of conveyance, a detector that is positioned between the roller and the fixation member and configured to detect a force received from the recording medium via the roller, a support member having an elastic member, and a roller movement unit that is connected to the support member and is configured to move the roller in the direction intersecting with the direction of conveyance.

In the first mode of the invention (image recording apparatus) thus configured, the roller is supported by the fixation member. The fixation member supports the roller via the detector, and the configuration is such that detecting the force applied to the fixation member from the recording medium via the roller enables the detector to detect the tension of the recording medium. The support member is configured so that moving in the direction intersecting with the direction of conveyance makes it possible to move the roller in the direction intersecting with the direction of conveyance.

The support member supports the roller via the elastic member. As such, the proportion of the force received from the recording medium by the roller that is distributed to the support member is curbed, and consequently the proportion that is applied to the fixation member is adequately ensured, compared to a configuration of fitting to the roller at a fixed plate but not via the elastic member. Moreover, as described earlier, the fixation member supports the roller via the detector. Therefore, the force received from the recording medium by the roller can be securely transmitted to the detector. Thus, in the first mode of the present invention, it becomes possible to accurately detect the tension of the recording medium on the basis of the force received from the recording medium by the roller, even while configuring so that the roller is movable in the direction intersecting with the direction of conveyance.

The image recording apparatus may be configured so that the support member has a fixed plate and the elastic member fixed to the fixed plate, and the elastic member has a smaller spring constant than the fixed plate.

The image recording apparatus may be configured so that the detector has a strain body that is configured to deform elastically at a first spring constant in accordance with the force received from the roller, and detects the force received from the recording medium via the roller based on an amount of deformation of the strain body, the elastic member having an elasticity of elastic deformation at a second spring constant that is smaller than the first spring constant and greater than zero. With the configuration of such configuration, the detector detects the force received from the roller on the basis of the amount of deformation at which the strain body is elastically deformed. Here, the second spring constant of the elastic member is set so as to be smaller than the first spring constant of the strain body. Therefore, the proportion of the force received from the recording medium by the roller that is applied to a first support member is ensured while the proportion that is distributed to a second support member is curbed, and consequently the force received from the recording medium by the roller can be securely transmitted to the detector. Thus, it becomes possible to accurately detect the tension of the recording medium on the basis of the force received from the recording medium by the roller, while also configuring the roller so as to be movable in the axial direction.

The image recording apparatus may be configured so that the second spring constant is equal to or lower than 1% of the first spring constant. Having the configuration of such description makes it possible to ensure a large proportion of the force received from the recording medium by the roller that is applied to the first support member, and consequently makes it possible for the force received from the recording medium by the roller to be securely transmitted to the detector.

More specifically, the image recording apparatus may be configured so that the second spring constant is equal to or lower 25 N/mm and greater than 0 N/mm.

The image recording apparatus may be configured so that the elastic member has a spring constant greater than the second spring constant in the direction intersecting with the direction of conveyance. Having the configuration of such description makes it possible to have the roller, supported on the second support member via the elastic member, accurately follow the movement in the direction intersecting with the direction of conveyance.

The image recording apparatus may be configured so that the roller has a rotating member that is configured to rotate about the support shaft as a rotating shaft and move in the direction intersecting with the direction of conveyance along with the support shaft, the rotating member contacts the recording medium that is being conveyed, the fixation member supports the support shaft via the detector, and the support member is fitted to the support shaft via the elastic member.

With this configuration, the roller has the support shaft and the rotating member that is rotatable about the support shaft, and there is contact with the recording medium at the rotating member. The support shaft of the roller is supported by the fixation member. The fixation member supports the support shaft of the roller via the detector, and the configuration is such that detecting the force applied to the fixation member from the rotating member via the support shaft enables the detector to detect the tension of the recording medium. The configuration is also such that move in the direction intersecting with the direction of conveyance enables the support member to move the rotating member and support shaft of the roller in the direction intersecting with the direction of conveyance.

Here, the support member is fitted to the support shaft of the roller via the elastic member. As such, the proportion of the force received from the recording medium by the roller at the rotating member that is distributed to the support member is curbed, and consequently the proportion that is applied to the fixation member is ensured, compared to a configuration of fitting to the roller at a fixed plate but not via the elastic member. Moreover, as described earlier, the fixation member supports the support shaft of the roller via the detector. Therefore, the force received from the recording medium at the rotating member by the roller can be securely transmitted to the detector via the support shaft supporting the rotating member. In this manner, in this configuration, as well, it becomes possible to accurately detect the tension of the recording medium on the basis of the force received from the recording medium by the roller, while also configuring the roller so as to be movable in the direction intersecting with the direction of conveyance.

A second mode of an image recording apparatus as in the invention, in order to solve the above-described objective, comprises a roller that is configured to contact with a recording medium, and that is configured to rotate in a direction of conveyance of the recording medium, and that has a support shaft extending in a direction intersecting with the direction of conveyance, a detector configured to detect a force received from the recording medium via the roller, a fixation member fixing the roller movably in the direction intersecting with the direction of conveyance, via the detector, a support member connected to the fixation member, and a roller movement mechanism that is connected to the support member and is configured to move the roller in the direction intersecting with the direction of conveyance.

In the second mode of the invention (image recording apparatus) thus configured, the support member supports the roller via the detector, which is attached to the roller and detects the force received from the roller. As such, detecting the force applied to the support member from the roller allows the detector to detect the tension of the recording medium. The detector is configured so as to be movable in the direction intersecting with the direction of conveyance along with the roller, and the support member can move in the direction intersecting with the direction of conveyance and thus move the roller in the direction intersecting with the direction of conveyance along with the detector. In other words, in the second mode of the invention, the support member fulfills dual functions of supporting the roller via the detector and also moving the roller in the direction intersecting with the direction of conveyance. As such the force received by the roller from the recording medium will not be distributed to another support member provided in order to move the roller in the axial direction, other than the support member for supporting the roller via the detector. Thus, in the second mode of the invention, it becomes possible to accurately detect the tension of the recording medium on the basis of the force received from the recording medium by the roller while also configuring the roller so as to be movable in the direction intersecting with the direction of conveyance.

BRIEF DESCRIPTION OF THE DRAWINGS

Referring now to the attached drawings which form a part of this original disclosure:

FIG. 8 is a drawing illustrating, in graph form, the result of measurement illustrated in FIG. 7;

FIG. 9 is a drawing illustratively exemplifying, in tabular form, how the spring constant of a leaf spring impacts the tension detection accuracy;

FIG. 10 is a drawing illustrating, in graph form, the result of measurement illustrated in FIG. 9;

DETAILED DESCRIPTION OF EXEMPLARY EMBODIMENTS

Figure 1:
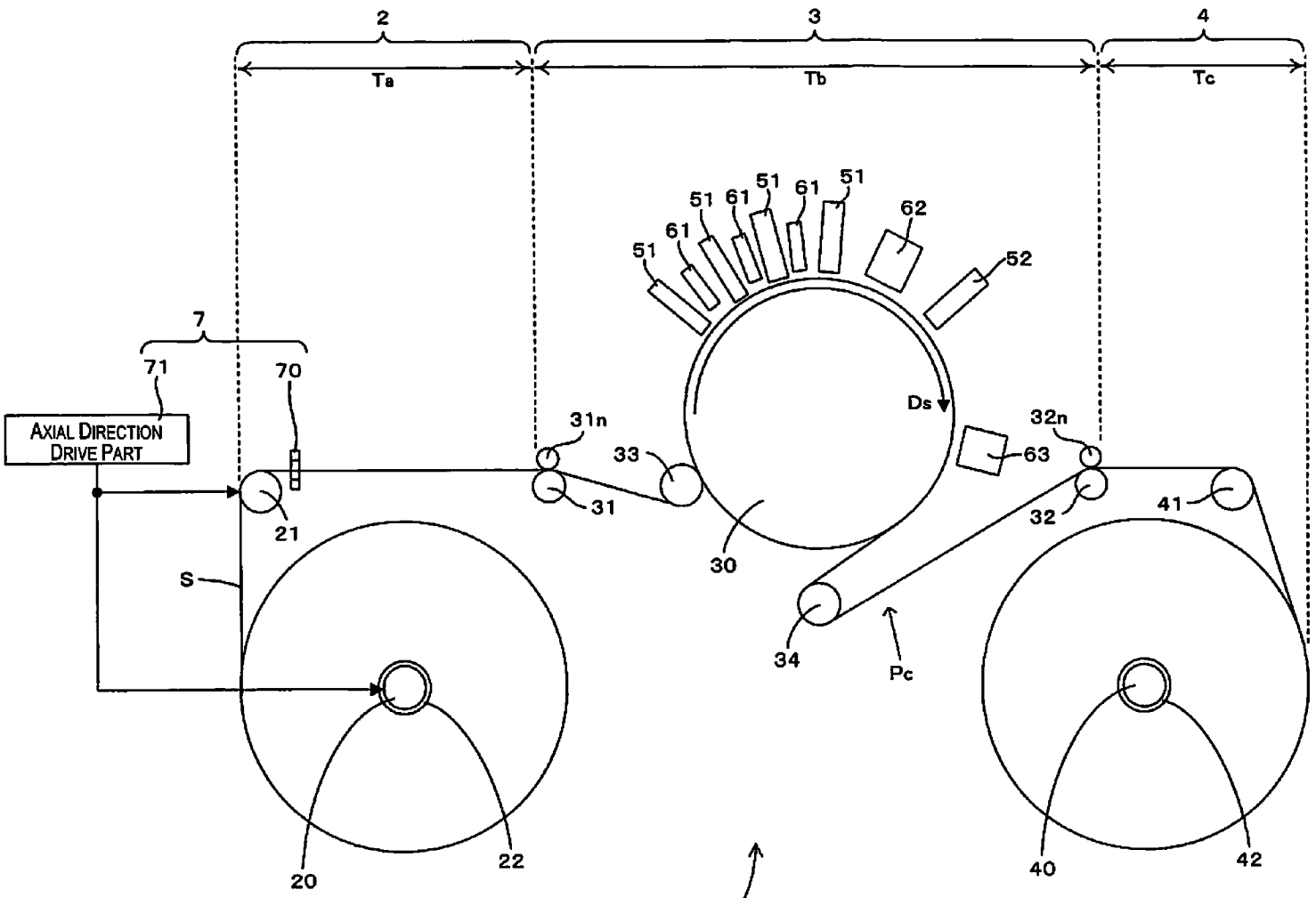
FIG. 1 is a drawing illustrating an example of an apparatus configuration provided to a printer to which the present invention can be applied.

FIG. 1 is a front view schematically illustrating an example of an apparatus configuration provided to a printer to which the invention can be applied. As illustrated in FIG. 1, in a printer 1, a single sheet S (web) both ends of which have been wound up in the shape of a roll around a feed-out spindle 20 and a take-up spindle 40 is extended in a tensioned state along a conveying path Pc, and the sheet S undergoes image recording while also being conveyed in a direction of conveyance Ds going from the feed-out spindle 20 toward the take-up spindle 40. The type of the sheet S is largely divided into paper-based and film-based. As specific examples, paper-based includes high-quality paper, cast paper, art paper, coated paper, and the like, while film-based includes synthetic paper, PET (polyethylene terephthalate), PP (polypropylene), and the like. As an overview, the printer 1 is provided with: a feed-out part 2 (feed-out region) for feeding the sheet S out from the feed-out spindle 20; a process part 3 (process region) for recording an image onto the sheet S fed out from the feed-out part 2; and a take-up part 4 (take-up region) for taking the sheet S, onto which an image was recorded at the process part 3, up into the take-up spindle 40. In the following description, whichever side of the two sides of the sheet S is the one on which the image is recorded is referred to as the "(front) surface", while the side opposite thereto is referred to as the "back surface".

The feed-out part 2 has the feed-out spindle 20, around which an end of the sheet S has been wound, as well as a driven roller 21 around which the sheet S having been drawn out from the feed-out spindle 20 is wound. The feed-out spindle 20 supports the end of the sheet S wound therearound in a state where the front surface of the sheet S faces outward. When the feed-out spindle 20 is rotated in the clockwise direction in FIG. 1, the sheet S having been wound around the feed-out spindle 20 is thereby made to pass via the driven roller 21 and fed out to the process part 3. The driven roller 21 is contacted with the sheet S and is intended to receive a frictional force against the sheet S being conveyed and be rotatingly driven in the direction of conveyance Ds of the sheet S. Here, the sheet S is wound up around the feed-out spindle 20 with a core tube 22 therebetween, the core tube 22 being detachable with respect to the feed-out spindle 20. As such, once the sheet S on the feed-out spindle 20 has been used up, then a new core tube 22 around which a roll of the sheet S has been wound can be mounted onto the feed-out spindle 20 to replace the sheet S of the feed-out spindle 20.

The feed-out spindle 20 and the driven roller 21 are enabled to move in an axial direction Da (a direction perpendicular to the plane in FIG. 1) orthogonal to the direction of conveyance Ds; the feed-out part 2 is equipped with a steering mechanism 7 for reining in meandering of the sheet S by adjusting the positions of the feed-out spindle 20 and the driven roller 21 in the axial direction Da (the width direction of the sheet S). This steering mechanism 7 is constituted of an edge sensor 70 and an axial direction drive part 71. The edge sensor 70 is provided so as to face an end of the sheet S in the axial direction Da, on the side of the driven roller 21 downstream in the direction of conveyance Ds, and detects the position of the end of the sheet S in the axial direction Da. The axial direction drive part 71 reins in meandering of the sheet S by adjusting the positions of the feed-out spindle 20 and the driven roller 21 in the axial direction Da on the basis of the result of detection of the edge sensor 70.

The process part 3 is intended to record an image onto the sheet S by carrying out a process onto the sheet S, as appropriate, using functional parts 51, 52, 61, 62, 63 arranged along the outer peripheral surface of a rotating drum 30 while the rotating drum 30 supports the sheet S having been fed out from the feed-out part 2. At the process part 3, a front drive roller 31 and a rear drive roller 32 are provided to the two ends of the rotating drum 30 in the direction of conveyance Ds, and the sheet S, which is conveyed from the front drive roller 31 to the rear drive roller 32, is supported by the rotating drum 30 and undergoes the image recording.

The front drive roller 31 has on the outer peripheral surface a plurality of minute projections formed by thermal spraying, and the sheet S having been supplied from the feed-out part 2 is wound around from the back surface side. When the front drive roller 31 is rotated in the clockwise direction in FIG. 1, the sheet S having been supplied from the feed-out part 2 is thereby conveyed downstream on the conveyance path. A nip roller 31*n* is provided facing the front drive roller 31. This nip roller 31*n* abuts against the surface of the sheet S in a state of having been urged to the front drive roller 31 side, and nips the sheet S with the front drive roller 31 on the other side. This ensures the force of friction between the front drive roller 31 and the sheet S, and makes it possible for the front drive roller 31 to reliably convey the sheet S.

The rotating drum 30 is a drum of cylindrical shape having a diameter of, for example, 40 mm, rotatably supported by a support mechanism (not shown), and winds the sheet S conveyed from the front drive roller 31 to the rear drive roller 32 up from the back surface side. This rotating drum 30 is intended to receive the force of friction against the sheet S being conveyed and be rotatingly driven in the direction of conveyance Ds of the sheet S, while also supporting the sheet S from the back surface side. Here, at the process part 3, driven rollers 33, 34 for altering the direction of travel of the sheet S are provided at both ends, in the direction of conveyance Ds, of a wind-up part, which is a region where the sheet S is wound up around the rotating drum 30. Of these, the driven roller 33 winds up the front surface of the sheet S between the rotating drum 30 and the front drive roller 31 in the direction of conveyance Ds, and loops the direction of travel of the sheet S back in an orientation going toward the rotating drum 30. In turn, the driven roller 34 winds up the front surface of the sheet S between the rear drive roller 32 and the rotating drum 30 in the direction of conveyance Ds, and loops the direction of travel of the sheet S back. This manner of looping the sheet S back at the upstream and downstream sides in the direction of conveyance Ds relative to the rotating drum 30 makes it possible to ensure the length of the wind-up part of the sheet S for wind-up onto the rotating drum 30.

The rear drive roller 32 has on the outer peripheral surface a plurality of minute projections formed by thermal spraying, and the sheet S having been conveyed from the rotating drum 30 via the driven roller 34 is wound therearound from the back surface side. When the rear drive roller 32 is rotated in the clockwise direction in FIG. 1, the sheet S is thereby conveyed toward the take-up part 4. A nip roller 32*n* is provided facing the rear drive roller 32. This nip roller 32*n* abuts against the surface of the sheet S in a state of having been urged to the rear drive roller 32 side, and nips the sheet S with the rear drive roller 32 on the other side. This ensures the force of friction between the rear drive roller 32 and the sheet S, and makes it possible for the rear drive roller 32 to reliably convey the sheet S.

In this manner, the sheet S being conveyed from the front drive roller 31 to the rear drive roller 32 is supported on the outer peripheral surface of the rotating drum 30. Also, at the process part 3, in order to record a color image onto the front surface of the sheet S being supported on the rotating drum 30, a plurality of recording heads 51 corresponding to mutually different colors are provided. Specifically, four recording heads 51 corresponding to yellow, cyan, magenta, and black are lined up in the stated order of colors in the conveyance direction Ds. Each of the recording heads 51 faces the front surface of the sheet S wound around the rotating drum 30, leaving a slight clearance with respect thereto, and discharges the ink of the corresponding color (color ink) in an inkjet format from nozzles belonging to the recording head. When each of the recording heads 51 discharges ink onto the sheet S being conveyed toward the conveyance direction Ds, a color image is thereby formed on the front surface of the sheet S.

Here, the ink used is a UV (ultraviolet) ink that is cured by being irradiated with ultraviolet rays (light) (i.e., is a photocurable ink). Therefore, in the process part 3, UV irradiators 61, 62 (light irradiation parts) are provided in order to cur the ink and fix the ink to the sheet S. The execution of this curing of the ink is divided into two stages, which are temporary curing and true curing. A UV irradiator 61 for temporary curing is arranged in between each of the plurality of recording heads 51. In other words, the UV irradiators 61 are intended to irradiate with ultraviolet rays of low irradiation intensity and thereby cure the ink to such an extent that the ink wets and spreads sufficiently slower than when not irradiated with ultraviolet rays (that is, is intended to temporarily cure the ink), and is not intended to truly cure the ink. The UV irradiator 62 for true curing, meanwhile, is provided to the downstream side in the direction of conveyance Ds relative to the plurality of recording heads 51. In other words, the UV irradiator 62 is intended to irradiate with ultraviolet rays of a greater irradiation intensity than the UV irradiators 61, and thereby cure the ink to such an extent that the wetting and spreading of the ink stops (i.e., is intended to truly cure the ink).

In this manner, the color inks discharged onto the sheet S from the recording heads 51 on the upstream side of the direction of conveyance Ds are temporarily cured by the UV irradiators 61 arranged between each of the plurality of recording heads 51. As such, the ink that is discharged onto the sheet S by one recording head 51 is temporarily cured until reaching the recording head 51 that is adjacent to the one recording head 51 on the downstream side in the direction of conveyance Ds. The occurrence of color mixing, where color inks of different colors mix together, is thereby reined in. In this state where color mixing has been reined in, the plurality of recording heads 51 discharge the color inks of mutually different colors and form the color image on the sheet S. Furthermore, the UV irradiator 62 for true curing is provided further downstream in the direction of conveyance Ds than the plurality of recording heads 51. Therefore, the color image that has been formed by the plurality of recording heads 51 is truly cured by the UV irradiator 62 and fixed onto the sheet S.

A recording head 52 is also provided to the downstream side in the direction of conveyance Ds relative to the UV irradiator 62. This recording head 52 faces the front surface of the sheet S that is wound up around the rotating drum 30, leaving a slight clearance with respect thereto, and discharges a transparent UV ink onto the front surface of the sheet S in an inkjet format from a nozzle. In other words, the transparent ink is additionally discharge onto the color image formed by the recording heads 51 of the four different colors. This transparent ink is discharged onto the entire surface of the color image, and endows the color image with a glossy or matte texture. A UV irradiator 63 is also provided to the downstream side in the direction of conveyance Ds relative to the recording head 52. This UV irradiator 63 is intended to irradiate with ultraviolet rays of a greater irradiation intensity than the UV irradiator 61, and thereby truly cure the transparent ink that has been discharged by the recording head 52. This makes it possible to fix the transparent ink onto the front surface of the sheet S.

In this manner, in the process part 3, the sheet S that is wound around the outer peripheral part of the rotating drum 30 undergoes discharging and curing of the inks as appropriate, and a color ink that is textured with transparent ink is formed. The sheet S on which the color image has been formed is then conveyed toward the take-up part 4 by the rear drive roller 32.

In addition to the take-up spindle 40 around which an end of the sheet S is wound, the take-up part 4 also has a driven roller 41 around which the sheet S is wound from the back surface side between the take-up spindle 40 and the rear drive roller 32. The take-up spindle 40 supports one end of the sheet S taken up therearound in a state where the front surface of the sheet S is facing outward. In other words, when the take-up spindle 40 is rotated in the clockwise direction in FIG. 1, the sheet S, which has been conveyed from the rear drive roller 32, passes through the driven roller 41 and is taken up around the take-up spindle 40. Here, the sheet S is taken up around the take-up spindle 40 with a core tube 42 therebetween, the core tube 42 being detachable with respect to the take-up spindle 40. As such, when the sheet S taken up around the take-up spindle 40 is full, then it becomes possible to remove the sheet S with the core tube 42.

Figure 2:
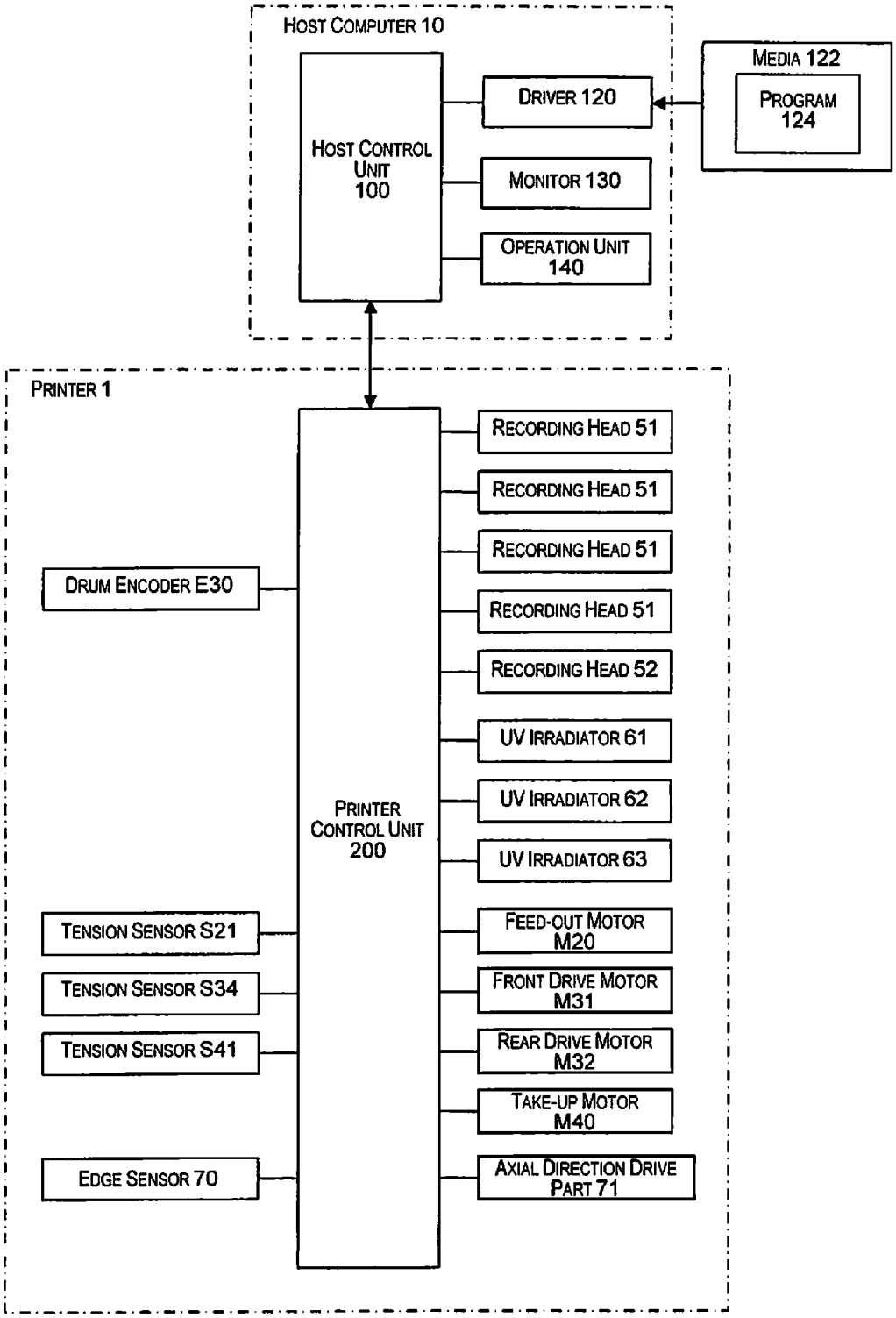
FIG. 2 is a drawing schematically illustrating an electrical configuration for controlling the printer illustrated in FIG. 1.

The foregoing is a summary of the apparatus configuration of the printer 1. The following description shall relate to the electrical configuration for controlling the printer 1. FIG. 2 is a block diagram schematically illustrating the electrical configuration for controlling the printer 1 illustrated in FIG. 1. The operation of the printer 1 described above is controlled by a host computer 10 illustrated in FIG. 2. The host computer 10 may be provided to the printer 1, or may be provided to the exterior of the printer 1 separately from the printer 1. With the host computer 10, a host control unit 100 for governing all control operations is constituted of a central processing unit (CPU) and a memory. A driver 120 is also provided to the host computer 10, and this driver 120 reads out a program 124 from media 122. The media 122 can be a variety of different things, such as a CD (Compact Disk), DVD (Digital Versatile Disk), or USB (Universal Serial Bus) memory. The host control unit 100 also controls each of the parts of the host computer 10 and controls the operation of the printer 1, on the basis of the program 124 having been read out from the media 122.

A monitor 130 constituted of a liquid crystal display or the like and an operation unit 140 constituted of a keyboard, mouse, or the like are provided to the host computer 10 as interfaces for interfacing with an operator. In addition to an image to be printed, a menu screen is also displayed on the monitor 130. As such, by operating the operation unit 140 while also checking the monitor 130, the operator is able to open up a print setting screen from the menu screen and set the type of printing medium, the size of printing medium, the quality of printing, and a variety of other print conditions. A variety of modifications could be made to the specific configuration of the interface for interfacing with the operator; for example, a touch panel-type display may be used as the monitor 130, the operation unit 140 being then constituted of the touch panel of this monitor 130.

On the other hand, in the printer 1, a printer control unit 200 for controlling each of the parts of the printer 1 in accordance with a command from the host computer 10 is also provided. Each of the apparatus parts for the recording heads, the UV irradiators, and the sheet conveyance system are controlled by the printer control unit 200. The details of the manner in which the printer control unit 200 controls each of the apparatus parts are as follows.

The printer control unit 200 controls the ink discharge timing of each of the recording heads 51 for forming the color image, in accordance with the conveyance of the sheet S. More specifically, the control of the ink discharge timing is executed on the basis of the output (detection value) of a drum encoder E30 that is attached to a rotating shaft of the rotating drum 30 and detects the position of rotation of the rotating drum 30. In other words, because the rotating drum 30 is rotatingly driven in association with the conveyance of the sheet S, it is possible to ascertain the position of conveyance of the sheet S when the output of the drum encoder E30 for detecting the position of rotation of the rotating drum 30 is consulted. In view thereof, the printer control unit 200 generates a pts (print timing signal) signal from the output of the drum encoder E30 and controls the ink discharge timing of each of recording heads 51 on the basis of the pts signal, whereby the ink having been discharged by each of the recording heads 51 is impacted onto a target position on the sheet S that is being conveyed, thus forming the color image.

The timing whereby the recording head 52 discharges the transparent ink, too, is controlled by the printer control unit 200 in a similar fashion on the basis of the output of the drum encoder E30. This makes it possible for the transparent ink to be accurately discharged onto the color image having been formed by the plurality of recording heads 51. Moreover, the irradiation light intensity and the timing for turning the UV irradiators 61, 62, 63 on and off are also controlled by the printer control unit 200.

The printer control unit 200 also governs a function for controlling the conveyance of the sheet S, as described in detail with reference to FIG. 1. In other words, among the members constituting the sheet conveyance system, a motor is respectively connected to the feed-out spindle 20, the front drive roller 31, the rear drive roller 32, and the take-up spindle 40. The printer control unit 200 controls the speed and torque of each of the motors while causing the motors to rotate, and thus controls the conveyance of the sheet S. The details of this control of the conveyance of the sheet S are as follows.

The printer control unit 200 causes feed-out motors M20 for driving the feed-out spindle 20 to rotate, and feeds the sheet S from the feed-out spindle 20 to the front drive roller 31. The printer control unit 200 herein controls the torque of the feed-out motors M20 to adjust the tension (feed-out tension Ta) from the feed-out spindle 20 to the front drive roller 31. Namely, a tension sensor S21 for detecting the feed-out tension Ta is attached to the driven roller 21, which is arranged between the feed-out spindle 20 and the front drive roller 31 in the direction of conveyance Ds. The tension sensor S21 can be constituted of, for example, a load cell for detecting the force received from the sheet S. The printer control unit 200 carries out a feedback control of the torque of the feed-out motors M20 on the basis of a result of detection from the tension sensor S21, and thus adjusts the feed-out tension Ta of the sheet S.

The printer control unit 200 also rotates a front drive motor M31 for driving the front drive roller 31, and a rear drive motor M32 for driving the rear drive roller 32. The sheet S having been fed out from the feed-out part 2 is thereby passed through the process part 3. Herein, speed control is executed for the front drive motor M31, whereas torque control is executed for the rear drive motor M32. In other words, the printer control unit 200 adjusts the rotational speed of the front drive motor M31 to a constant speed, on the basis of an encoder output for the front drive motor M31. The sheet S is thereby conveyed at a constant speed by the front drive roller 31.

On the other hand, the printer control unit 200 controls the torque of the rear drive motor M32 and thus adjusts the tension (process tension Tb) of the sheet S from the front drive roller 31 to the rear drive roller 32. Namely, a tension sensor S34 for detecting the process tension Tb is attached to the driven roller 34, which is arranged between the rotating drum 30 and the rear drive roller 32 in the direction of conveyance Ds. This tension sensor S34 can be constituted, for example, of a load cell for detecting the force received from the sheet S. The printer control unit 200 also carries out feedback control of the torque of the rear drive motor M32 on the basis of a detection result from the tension sensor S34, and thus adjusts the process tension Tb of the sheet S.

The printer control unit 200 causes a take-up motor M40 for driving the take-up spindle 40 to rotate, and the sheet S conveyed by the rear drive roller 32 is taken up around the take-up spindle 40. Herein, the printer control unit 200 controls the torque of the take-up motor M40 and thus adjusts the tension (take-up tension Tc) of the sheet S from the rear drive roller 32 to the take-up spindle 40. Namely, a tension sensor S41 for detecting the take-up tension Tc is attached to the driven roller 41, which is arranged between the rear drive roller 32 and the take-up spindle 40 in the direction of conveyance Ds. This tension sensor S41 can be constituted, for example, of a load cell for detecting the force received from the sheet S. The printer control unit 200 carries out a feedback control of the torque of the take-up motor M40 on the basis of a result of detection of the tension sensor S41, and thus adjusts the take-up tension Tc of the sheet S.

Furthermore, the printer control unit 200 is also responsible for a control function in the previously described steering mechanism 7 provided in the feed-out part 2, and adjusts the position of the end of the sheet S to a target position in the axial direction Da by performing feedback control of the axial direction drive part 71 on the basis of the result of detection of the edge sensor 70. The target position is set so that the position of a center axis of the drive rollers 31, 32 matches with a center axis of the sheet S in the axial direction Da. As such, the sheet S is conveyed in the direction of conveyance Ds so that the center axis of the sheet S passes through the center axis of the drive rollers 31, 32. This makes it possible to convey the sheet S in the direction of conveyance Ds while the sheet S is being reined in from deviating in the axial direction Da, because the load received by the sheet S from the nips formed by the drive rollers 31, 32 is rendered uniform in the axial direction Da.

The foregoing is a summary of the electrical configuration for controlling the printer 1. As described above, the driven roller 21 provided to the feed-out part 2 functions as a steering roller able to move in the axial direction Da, and the tension sensor S21 for detecting the tension of the sheet S is attached thereto. Next, a peripheral configuration of this driven roller 21 shall be described.

Figure 3:
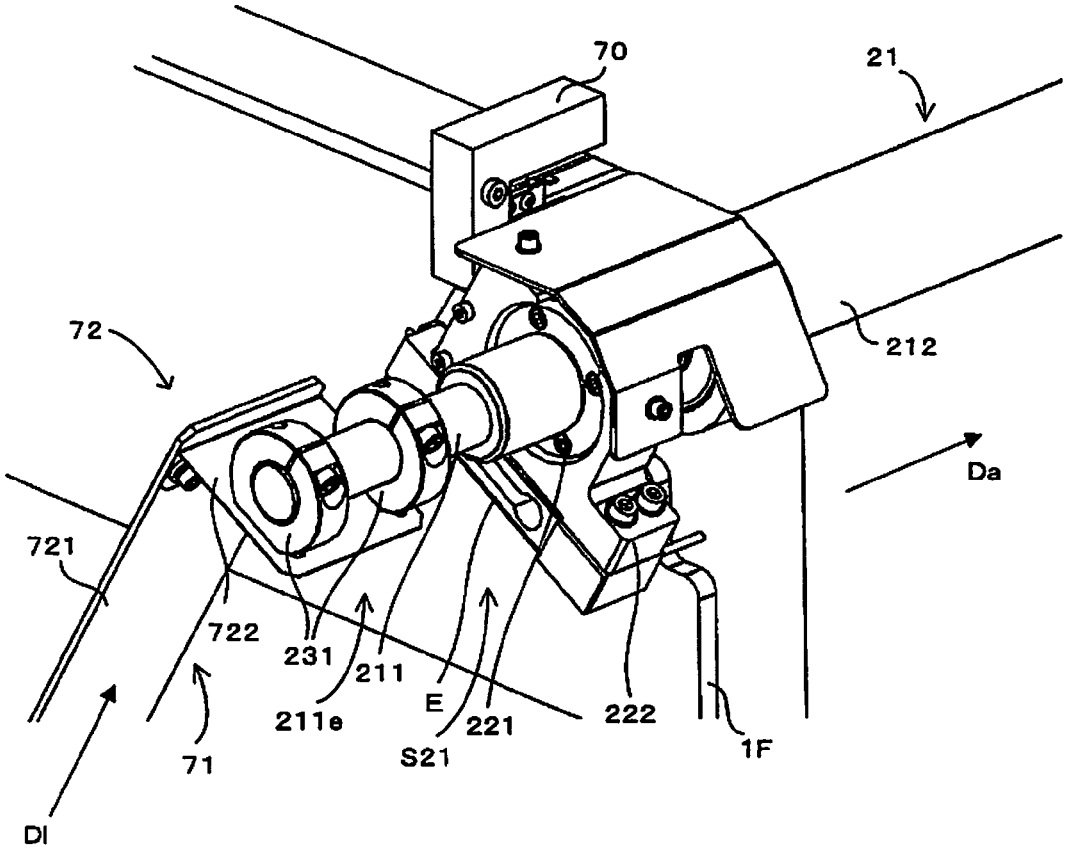
FIG. 3 is a perspective view illustratively exemplifying a portion of a peripheral configuration of a driven roller.

FIG. 3 is a perspective view illustratively exemplifying a portion of the peripheral configuration the driven roller. As illustrated in FIG. 3, the driven roller 21 has a roller shaft 211 extending in the axial direction Da and a cylinder member 212 of cylindrical shape that is fitted to the outer periphery of the roller shaft 211 and extends in the axial direction Da. The cylindrical member 212 is fitted to the roller shaft 211 via a ball bearing and is able to rotate about the roller shaft 211. Movement of the cylindrical member 212 in the axial direction Da relative to the roller shaft 211, however, is limited. The cylindrical member 212 is driven relative to the sheet S while winding the sheet S around from the back surface, and thereby rotates about the roller shaft 211.

An end part 211*e* of the roller shaft 211, which projects out beyond the cylindrical member 212 in the axial direction Da, is supported by a main body frame 1F of the printer 1 via the tension sensor S21. More specifically, a linear bushing 221 is fitted to the end part 211*e* of the roller shaft 211 from the outer peripheral side of the roller shaft 211, and a holder 222 holds the linear bushing 221 from the outside. The tension sensor S21, which is a load cell or the like, is attached to between the holder 222 and the main body frame 1F of the printer 1, and a force applied to the cylindrical member 212 of the driven roller 21 from the sheet S is applied to a strain body E of the tension sensor S21 via the linear bushing 221 and the holder 222. The strain body E deforms elastically at a spring constant Ke in a load direction Dl in accordance with the force applied, and the tension sensor S21 outputs a detection signal of a level corresponding to the amount of deformation of the strain body E. Thus, the tension sensor S21 detects the force received from the sheet S via the driven roller 21 on the basis of the amount of deformation of the strain body E. There is one tension sensor S21, one linear bushing 221, and one holder 222 provided to each of the two end parts of the roller shaft 211.

A support plate 72 is fitted to the end part 211*e* of the roller shaft 211 at the outside in the axial direction Da relative to the linear bushing 221. This support plate 72 has a fixed plate 721 arranged somewhat at an incline with respect to the vertical direction, and a leaf spring 722 of a flat shape fixed to an upper end part of the fixed plate 721. The leaf spring 722 has a width in the axial direction Da, has an elasticity of a spring constant Kp relative to the load direction Dl, and has rigidity relative to the axial direction Da. In other words, the leaf spring 722 has an elasticity of the spring constant Kp relative to the load direction Dl, and has an elasticity of a spring constant greater than the spring constant Kp relative to the axial direction Da. The load direction Dl is found as the direction in which the force coming from the driven roller 21 acts on the tension sensor S21, and is substantially orthogonal to the axial direction Da. The spring constant Kp of the leaf spring 722 is smaller than the spring constant of the fixed plate 721. In turn, attached to the end part 211*e* of the roller shaft 211 are two set collars 231 provided to the outside of the axial direction Da relative to the linear bushing 221. These set collars 231 are connected to the leaf spring 722. Herein, saying that the set collars 231 are connected to the leaf spring 722 comprises a state where the set collars 231 and the leaf spring 722 are fitted together and a state where the set collars 231 and the leaf spring 722 are fixed together. The leaf spring 722 may also be fixed to the roller shaft 211 without the intermediary of set collars. Thus, the support plate 72 is connected to the roller shaft 211 of the driven roller 21 via the fixed plate 721, the leaf spring 722, and the set collars 231.

The spring constant Kp of the leaf spring 722 is smaller than the spring constant Ke of the strain body E of the tension sensor S21 (Ke>Kp>0). More specifically, the spring constant Kp of the leaf spring 722 may be set to a value 10% or less of the spring constant Ke of the strain body E and greater than 0%. Alternatively, the spring constant Kp of the leaf spring 722 may be set to a value 1% or less of the spring constant Ke of the strain body E and greater than 0%. In terms of absolute values, the spring constant Kp of the leaf spring 722 may be set to, for example, a value 25 N/mm or less and greater than 0 N/mm, or to a value 5 N/mm or less and greater than 0 N/mm.

As described below, the support plate 72 is moved in the axial direction Da by the axial direction drive part 71. In turn, as also described above, the roller shaft 211 of the driven roller 21 is supported by the main body frame 1F via the linear bushing 221. This linear bushing 221 is for fixing the roller shaft 211 to the main body frame 1F so as to be movable in the axial direction Da. As such, when the support plate 72 is moved in the axial direction Da by an operation of the axial direction drive part 71, then the driven roller 21 is also moved in the axial direction Da. In other words, the axial direction drive part 71 is able to move the driven roller 21 in the axial direction Da via the support plate 72.

Figure 4:
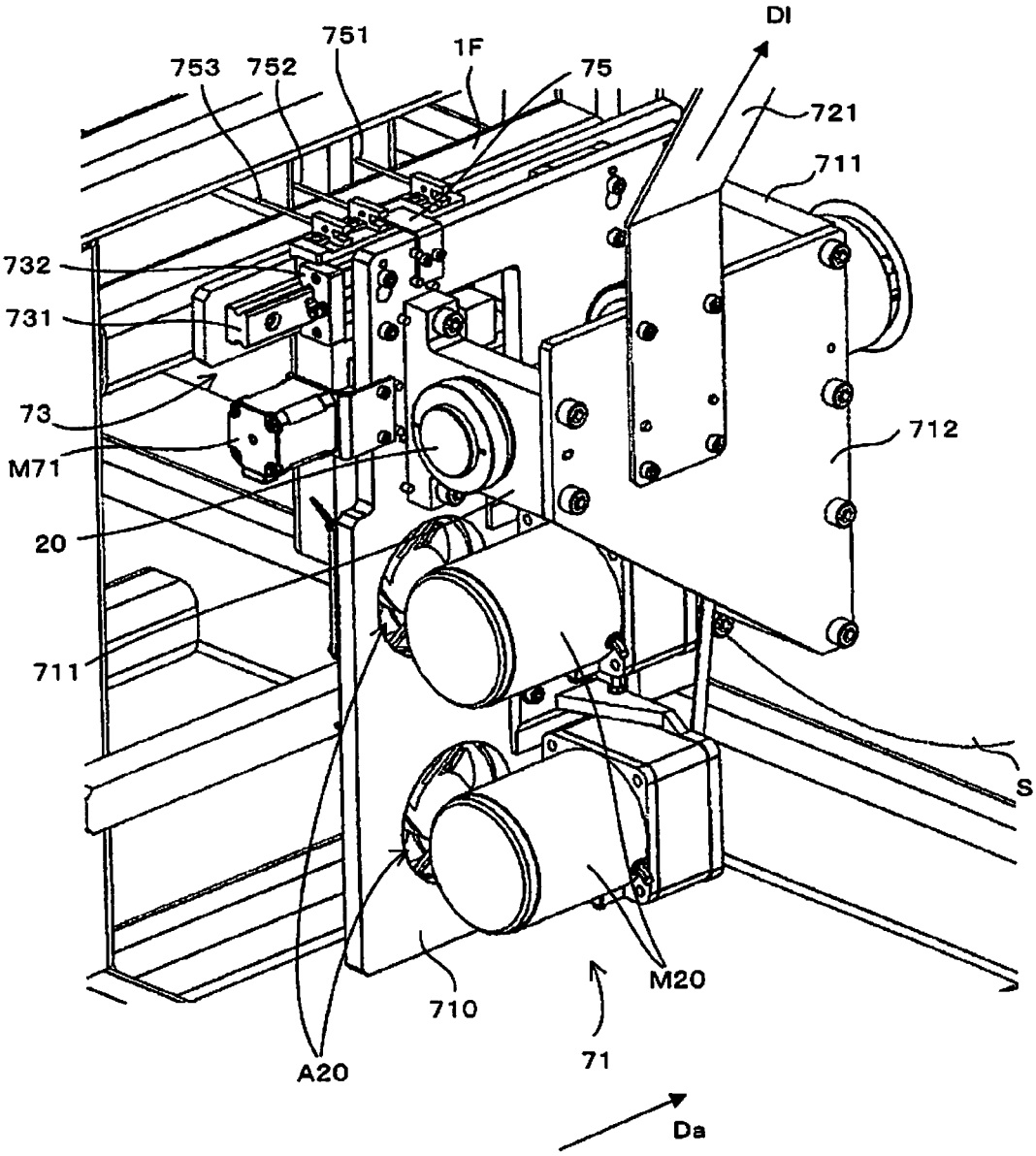
FIG. 4 is a perspective view illustratively exemplifying a portion of a configuration of an axial direction drive part as seen from obliquely outward.
Figure 5:
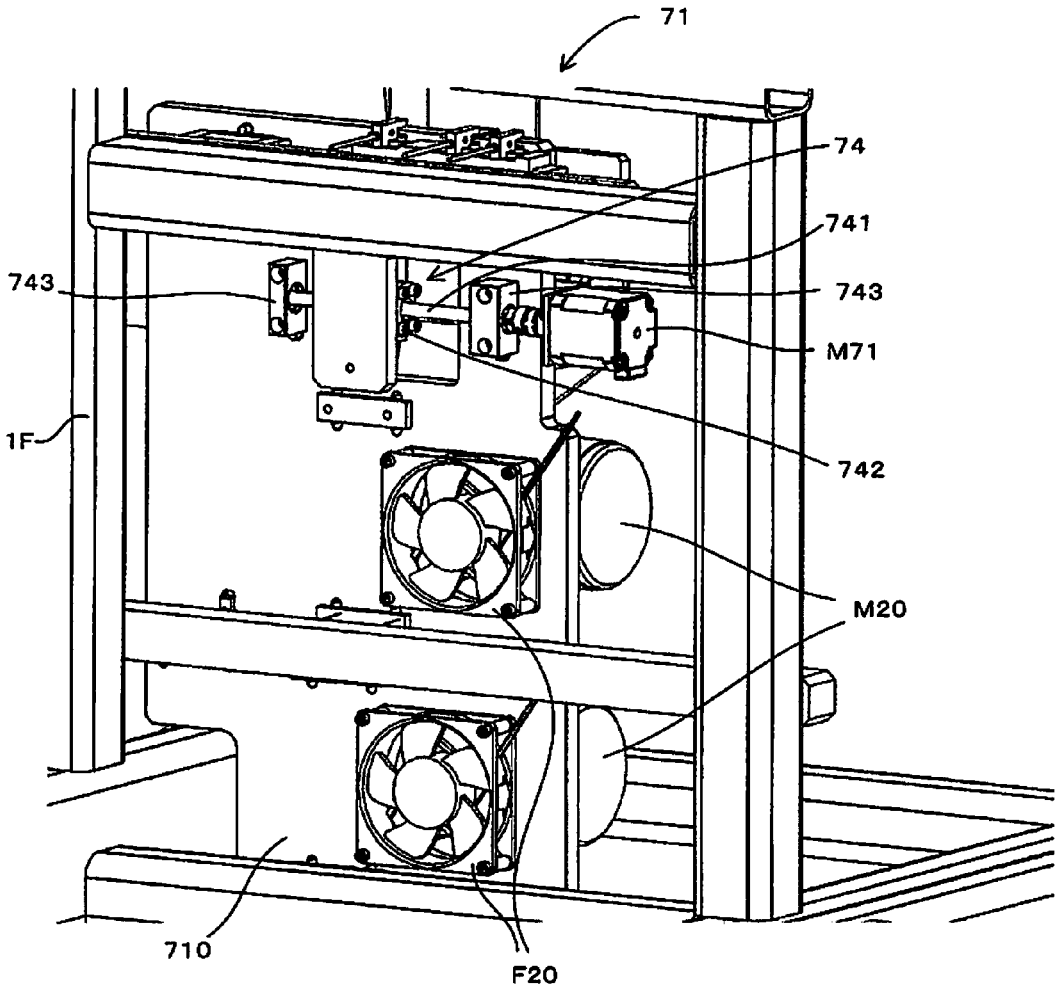
FIG. 5 is a perspective view illustratively exemplifying a portion of a configuration of an axial direction drive part as seen from obliquely inward.

FIG. 4 is a perspective view illustratively exemplifying a portion of a configuration of an axial direction drive part as seen from obliquely outward. FIG. 5 is a perspective view illustratively exemplifying a portion of a configuration of an axial direction drive part as seen from obliquely inward. The axial direction drive part 71 has a movable frame 710 having a flat plate shape that is long in the vertical direction and short in the axial direction Da. Two bearing plates 711 are arranged side by side projecting outwardly and spaced apart at an interval in the axial direction Da on an outside surface of the movable frame 710, and the feed-out spindle 20 is rotatably supported by the bearing plates 711. Bridged from the outside, an attachment plate 712 is attached to the bearing plates 711, and a lower end of the support plate 72 is attached to an outside surface of the attachment plate 712. The two feed-out motors M20 are attached to the outside surface of the movable frame 710, and the drive motors M20 drive the feed-out spindle 20. Two fans F20 are provided to an inside surface of the movable frame 710 so as to face the two feed-out motors M20; each of the fans F20 blows air to the feed-out motors M20 via an air inlet A20 formed with the feed-out motor M20 on the other side. The movable frame 710 is movable in the axial direction Da in association with each of the parts thus attached.

More specifically, a linear guide 73 constituted of a guide rail 731 extending in the axial direction Da and a movable member 732 that moves in the axial direction Da along the guide rail 731 are provided, the guide rail 731 being attached to the main body frame 1F, and the movable member 732 being attached to the movable frame 710. As such, the movable frame 710 can move in the axial direction Da along the guide rail 731 along with the movable member 732. A steering motor M71 is attached to an end part of the movable frame 710 in the axial direction Da in order to drive the movable frame 710, which is guided thus on the linear guide 73, in the axial direction Da relative to the main body frame 1F. The main body frame 1F and the steering motor M71 are coupled via a ball screw 74 provided on the inner side with respect to the movable frame 710. Namely, of a screw shaft 741 and a nut 742 constituting the ball screw 74, the screw shaft 741 extending in the axial direction D is attached to a rotating shaft of the steering motor M71, and the nut 742 is attached to the main body frame 1F and threaded onto the screw shaft 741. As such, causing the steering motor M71 to rotate makes it possible to move the movable frame 710 in the axial direction Da relative to the main body frame 1F. At the inside surface of the movable frame 710, a bearing 743 for receiving the screw shaft 741 is attached to each of two ends of the nut 742 in the axial direction Da.

With this configuration, causing the steering motor M71 to rotate enables the printer control unit 200 to move the driven roller 21 and the feed-out spindle 20 in the axial direction Da along with the movable frame 710. In particular, controlling the steering motor M71 on the basis of the result of detection of the edge sensor 70 enables the printer control unit 200 to adjust the positions of the driven roller 21 and the feed-out spindle 20 in the axial direction Da and thus to steer the sheet S.

Here, a detected member 75 and sensors 751, 752, 753 are provided in order to control the range of motion and point of origin of the movable frame 710. The detected member 75 is attached to the movable frame 710, whereas the three sensors 751, 752, 753 are arranged side by side in the axial direction Da above the detected member 75 and are attached to the main body frame 1F. Limit sensors 751, 753 are provided so as to corresponds to two ends of the range of motion of the movable frame 710 in the axial direction Da, and a point-of-origin sensor 752 is provided so as to correspond to a point of origin of the range of motion of the movable frame 710 in the axial direction Da. Namely, when the detected member 75 moves to a position facing the limit sensors 751, 753 along with the motion of the movable frame 710, then the limit sensors 751, 753 output a detection signal to the printer control unit 200. The printer control unit 200 stops the rotation of the steering motor M71 and stops the motion of the movable frame 710. At times such as before the operation of the printer 1 is stopped, then the printer control unit 200 causes the steering motor M72 to rotate and moves the movable frame 710 until the detected member 75 faces the point-of-origin sensor 752 and the point-of-origin sensor 752 outputs a detection signal to the printer control unit 200.

As described above, in the embodiment configured in this manner, the driven roller 21 is supported by the main body frame 1F. The main body frame 1F supports the driven roller 21 via the tension sensor S21, and is configured so that detecting the force applied to the main body frame 1F from the driven roller 21 enables the tension sensor S21 to detect the tension of the sheet S. The configuration is also such that when the support plate 72 moves in the axial direction Da, this makes it possible to move the driven roller 21 in the axial direction Da.

Here, the support plate 72 is fitted to the driven roller 21 via the fixed plate 721 and the leaf spring 722. As such, the proportion of the force received from the sheet S by the driven roller 21 that is distributed to the support plate 72 is curbed, and consequently the proportion that is applied to the main body frame 1F is adequately ensured, compared to a configuration of fitting to the driven roller 21 via the fixed plate 721 but not via the leaf spring 722. In addition, as described above, the main body frame 1F supports the driven roller 21 via the tension sensor S21. The force received from the sheet S by the driven roller 21 can therefore be securely transmitted to the tension sensor S21. Thus, in this embodiment, it becomes possible to accurately detect the tension of the sheet S on the basis of the force received from the sheet S by the driven roller 21, even while configuring so that the driven roller 21 is movable in the axial direction Da.

The tension sensor S21 also has the strain body E, which is elastically deformed at the spring constant Ke in accordance with the force received from the driven roller 21, and detects the force received from the driven roller 21 on the basis of the amount of deformation of the strain body E. The leaf spring 722 has an elasticity of elastic deformation at the spring constant Kp that is smaller than the spring constant Ke and is greater than zero. With the configuration of such description, the force received from the sheet S via the driven roller 21 is detected on the basis of the amount of deformation at which the strain body E is elastically deformed. At this time, the spring constant Kp of the leaf spring 722 is set so as to be smaller than the spring constant Ke of the strain body E. Therefore, the proportion of the force received from the sheet S by the driven roller 21 that is applied to the main body frame 1F is adequately ensured is sufficiently ensured while also the proportion that is distributed to the support plate 72 is curbed, and consequently the force received from the sheet S by the driven roller 21 can be securely transmitted to the tension sensor S21. Thus, it becomes possible to accurately detect the tension of the sheet S on the basis of the force received from the sheet S by the driven roller 21, even while configuring so that the driven roller 21 is movable in the axial direction Da.

Also, the spring constant Kp of the leaf spring 722 is 1% or less of the spring constant Ke of the strain body E. Using such a configuration makes it possible to ensure a large percentage of the force received from the sheet S by the driven roller 21 that is applied to the main body frame 1F, and consequently makes it possible to securely transmit, to the tension sensor S21, the force received from the sheet S by the driven roller 21.

The leaf spring 722 has rigidity in the axial direction Da. Using such a configuration makes it possible to have the driven roller 21, which is fitted to the support plate 72 via the leaf spring 722, accurately follow the movement of the support plate 72 in the axial direction Da.

Also, with this embodiment, the driven roller 21 has the roller shaft 211 and the cylindrical member 212 rotatable about the roller shaft 211, and supports the sheet S with the cylindrical member 212. The roller shaft 211 of the driven roller 21 is supported then by the main body frame 1F. The main body frame 1F supports the roller shaft 211 of the driven roller 21 via the tension sensor S21, and the tension sensor S21 detects the force applied to the main body frame 1F via the roller shaft 211 from the cylindrical member 212, thereby making it possible to detect the tension of the sheet S. By moving in the axial direction Da, the support plate 72 makes it possible to move the roller shaft 211 and the cylindrical member 212 of the driven roller 21 in the axial direction Da.

Here, the support plate 72 is fitted to the roller shaft 211 of the driven roller 21 via the fixed plate 721 and the leaf spring 722. As such, the proportion of the force received from the sheet S by the driven roller 21 at the cylindrical member 212 that is distributed to the support plate 72 is curbed, and consequently the proportion that is applied to the main body frame 1F is adequately ensured, compared to a configuration of fitting to the driven roller 21 via the fixed plate 721 but not via the leaf spring 722. In addition, as described above, the main body frame 1F supports the roller shaft 211 of the driven roller 21 via the tension sensor S21. The force received from the sheet S at the cylindrical member 212 by the driven roller 21 can therefore be securely transmitted to the tension sensor S21 via the roller shaft 211 supporting the cylindrical member 212. Thus, in this configuration as well, it becomes possible to accurately detect the tension of the sheet S on the basis of the force received from the sheet S by the driven roller 21, while also configuring the driven roller 21 so as to be movable in the axial direction Da.

Figures 6, 7:
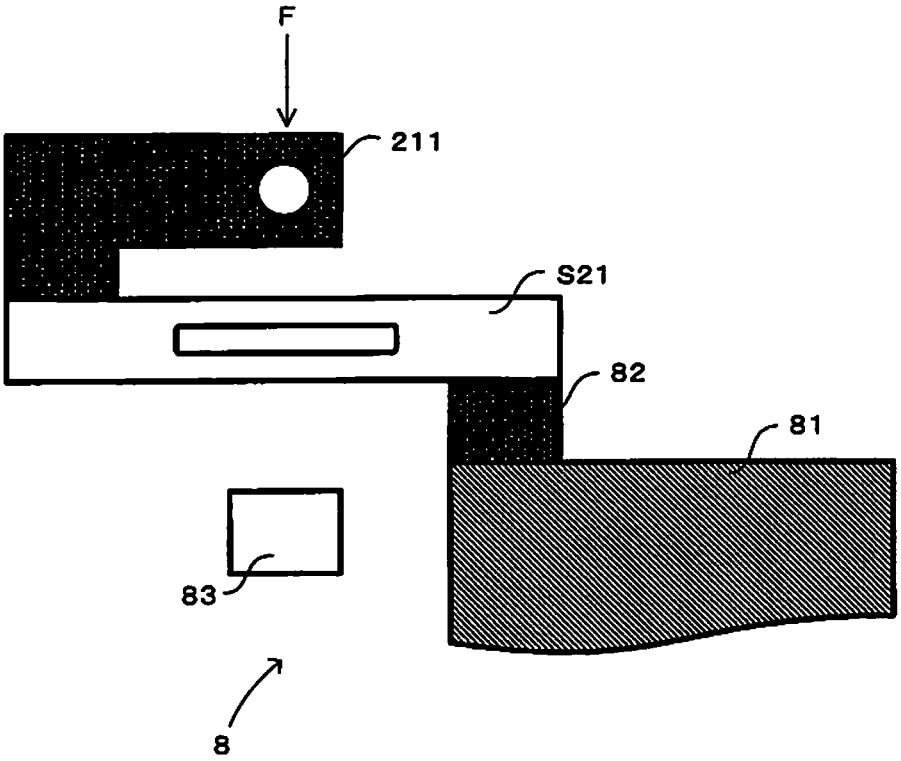
FIG. 6 is a drawing schematically illustrating a method of measuring a spring constant for a tension sensor.
FIG. 7 is a drawing illustrating, in tabular form, an example of a result of measurement by the method of measurement in FIG. 6.

Herein, a method for measuring the spring constant Ke of the tension sensor S21 shall be illustratively exemplified, as shall the impact the spring constant Kp of the leaf spring 722 has on the tension detection accuracy. FIG. 6 is a drawing schematically illustrating a method of measuring the spring constant Ke of the tension sensor S21. FIG. 7 is a drawing illustrating, in tabular form, the results of measurement by the method of measurement in FIG. 6, and FIG. 8 is a drawing illustrating in graph form the results of measurement illustrated in FIG. 7. As illustrated in FIG. 6, a measurement jig 8 for the spring constant Ke is constituted of a stage 81, a block 82 fixed onto an upper surface of the stage 81, and a laser displacement gauge 83 arranged to the side of the stage 81. The laser displacement gauge 83 can be configured, for example, using a LK-G30 (Keyence) as a sensor head and a LK-G3000 (Keyence) as a controller. The holder 222 and the tension sensor S21 are attached to the block 82 in a state of protruding out to the laser displacement gauge 83 side, and the (strain body E of the) tension sensor S21 faces the laser displacement gauge 83 from above. The displacement of the tension sensor S21 is measured with the laser displacement gauge 83 while a load F acting on the holder 222 in parallel to the load direction Dl is being varied. From the results obtained, as in FIGS. 7 and 8, the slope of the change in load relative to the displacement can be calculated to find the spring constant Ke of the (strain body E of the) tension sensor S21. For example, in the example in FIGS. 7 and 8, the spring constant Ke is found to be 2610.6 N/mm.

FIG. 9 is a drawing illustrating, in tabular form, the impact that the spring constant Kp of the leaf spring 722 has on the tension detection accuracy in a case where the tension sensor S21 has the spring constant Ke illustrated in FIGS. 7 and 8. FIG. 9 illustrates a load detection error (%) in a case where the load is changed to 10 N, 40 N, and 80 N when the spring constant Kp of the leaf spring 722 is small (5.33 N/mm) and when the spring constant Kp of the leaf spring 722 is large (24.66 N/mm), each. FIG. 10 is a drawing illustrating, in graph form, the result of measurement illustrated in FIG. 9. For the load detection error here, a percentage is used to represent the proportions of the force applied to the driven roller 21 that is distributed to the leaf spring 722 and provides elastic deformation of the leaf spring 722. These drawings show that with a smaller spring constant N/mm of the leaf spring 722, the load detection error is also correspondingly smaller. In particular, having the spring constant Kp of the leaf spring 722 be 25 N/mm makes it possible to keep the detection error to 5% or lower, and having the spring constant Kp of the leaf spring 722 be 5 N/mm or lower makes it possible to keep the detection error to 3% or lower.

As above, in the present embodiment, the printer 1 corresponds to one example of the "image recording apparatus" of the invention. The driven roller 21 corresponds to one example of the "roller" of the invention. The tension sensor S21 corresponds to one example of the "detector" of the invention. The main body frame 1F corresponds to one example of the "fixation member" of the invention. The fixed plate 721 corresponds to one example of the "fixed plate" of the invention. The leaf spring 722 corresponds to one example of the "elastic member" of the invention. The support plate 72 corresponds to one example of the "support member" of the invention. The axial direction drive mechanism 71 corresponds to one example of the "roller movement unit" of the invention. The strain body E corresponds to one example of the "strain body" of the invention. The spring constant Ke of the strain body E corresponds to one example of the "first spring constant" of the invention. The spring constant Kp of the leaf spring 722 corresponds to one example of the "second spring constant" of the invention. The roller shaft 211 corresponds to one example of the "support shaft" of the invention. The cylindrical member 212 corresponds to one example of the "rotating member" of the invention.

The invention is not to be limited to the embodiment described above; rather, a variety of different modifications can be added to what has been described above, provided that there is no departure from the spirit of the invention. As such, for example, the members that can be used as the "elastic member" of the invention are not limited to being the leaf spring 722 described above, but rather may be a rubber or spring having another shape, or the like. The mechanisms that can be used as the "detector" of the invention can also be variously modified from the above description. As the configuration for supporting the driven roller 21, as well, it would be possible also to employ a configuration other than the main body frame 1F and support plate 72 illustratively exemplified above.

The embodiment above illustratively exemplified a case where the invention is applied to the printer 1, where the sheet S is supported on a drum of cylindrical shape (the rotating drum 30). However, the specific configuration for supporting the sheet S is not limited thereto. As such, the configuration may be one where the sheet S is supported on a plane belonging to a support part having a planar shape.

Modifications can also be made as appropriate to the number of, arrangement of, or colors discharged by the recording heads 51, 52, and the like. Modifications can also be made as appropriate to the number, arrangement, ultraviolet intensity, and the like of the UV irradiators 61 to 63. Moreover, modifications can be made as appropriate to the manner of conveyance of the sheet S, as well.

In the embodiment described above, the invention was applied to the printer 1, which is provided with the recording heads 51, 52 for discharging the UV inks. However, the invention may instead also be applied to a printer provided with recording heads for discharging inks other than the UV inks, e.g., a water-based ink such as a resin ink. Alternatively, the invention may be applied to a printer that performs printing by using something other than ink, such as toner.

Figure 11:
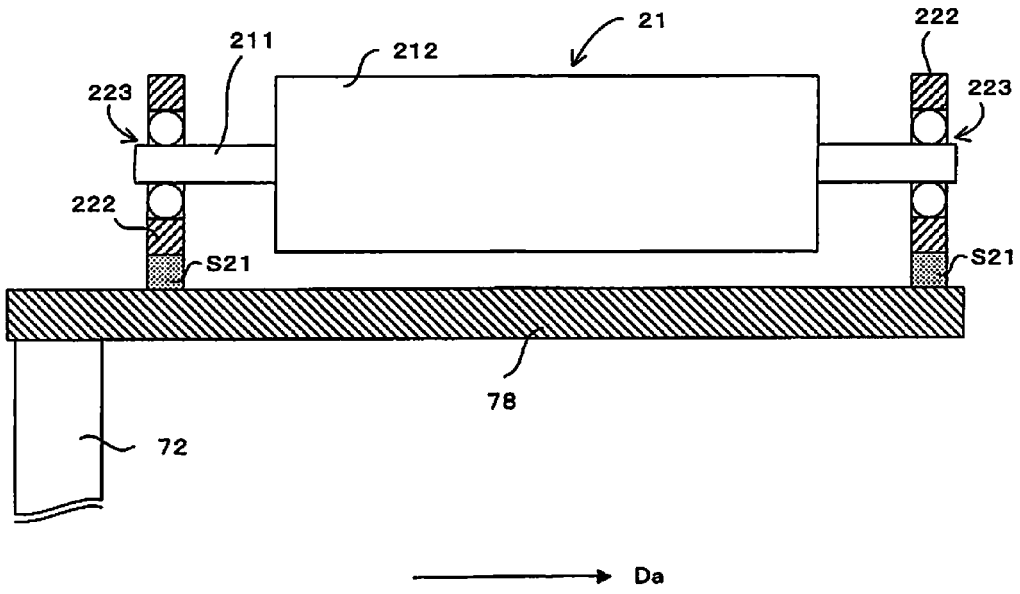
FIG. 11 is a schematic diagram illustrating a portion of a modification example 1 for the peripheral configuration of the driven roller.

The configuration of the driven roller 21 can also be modified as is illustrated in FIG. 11. FIG. 11 is a schematic view illustrating a portion of a modification example 1 of the peripheral configuration of the driven roller 21. Here, the description centers on the points of difference with the embodiment described above, and points in common with the embodiment described above are assigned the corresponding reference numerals and are omitted from the description. The modification example 1 differs from the embodiment described above in that the tension sensor S21 is fixed not to the main body frame 1F but rather to a roller fixation member 78 connected to the support plate 72, in that the roller shaft 211 and the cylindrical member 212 are rotated integrally, and in that a rolling bearing 223 is provided in place of the linear bushing 221.

More specifically, the roller fixation member 78, which extends in the axial direction Da, is attached to the upper end of the support plate 72. The roller shaft 211 and the cylindrical member are integrally formed, or the cylindrical member is non-rotatably fixed to the roller shaft 211. Further, provided in place of the linear bushing 221 is a rolling bearing 223, which holds the roller shaft 211 rotatably with respect to the holder 222. Additionally provided is a regulating member (not shown) for regulating movement of the roller shaft 211 in the axial direction Da relative to the holder 222. The leaf spring 722, which in the embodiment described above was provided to the upper end of the support plate 72, is eliminated in this modification example 1. The holder 222 for holding both ends of the roller shaft 211 of the driven roller 21 is attached to the roller fixation member 78 via the tension sensor S21. With this configuration, the roller fixation member 78 moves in the axial direction Da along with the tension sensor S21 and the driven roller 21 when the steering motor M71 is rotated and the support plate 72 is moved in the axial direction Da. Thus, the sheet S can be steered.

In the modification example 1 of the embodiment configured in this manner, the roller fixation member 78 fixes the driven roller 21 via the tension sensor S21, which is attached to the driven roller 21 and detects the force received from the driven roller 21. As such, detecting the force applied to the roller fixation member 78 from the driven roller 21 enables the tension sensor S21 to detect the tension of the sheet S. The tension sensor S21 is also configured so as to move in the axial direction Da along with the driven roller 21; the roller fixation member 78 moves in the axial direction Da, and causes the driven roller 21 to move in the axial direction Da along with the tension sensor S21. In other words, in this modification example 1, the roller fixation member 78 fulfills the dual functions of fixing the driven roller 21 via the tension sensor S21 and moving the driven roller 21 in the axial direction Da. As such, the force received by the driven roller 21 from the sheet S will not be dispersed to any other member provided in order to move the driven roller 21 in the axial direction Da, other than the roller fixation member 78 which supports the driven roller 21 via the tension sensor S21. Thus, in this modification example 1, it becomes possible to accurately detect the tension of the sheet S on the basis of the force received from the sheet S by the driven roller 21 while also configuring the driven roller 21 so as to be movable in the axial direction Da.

Figure 12:
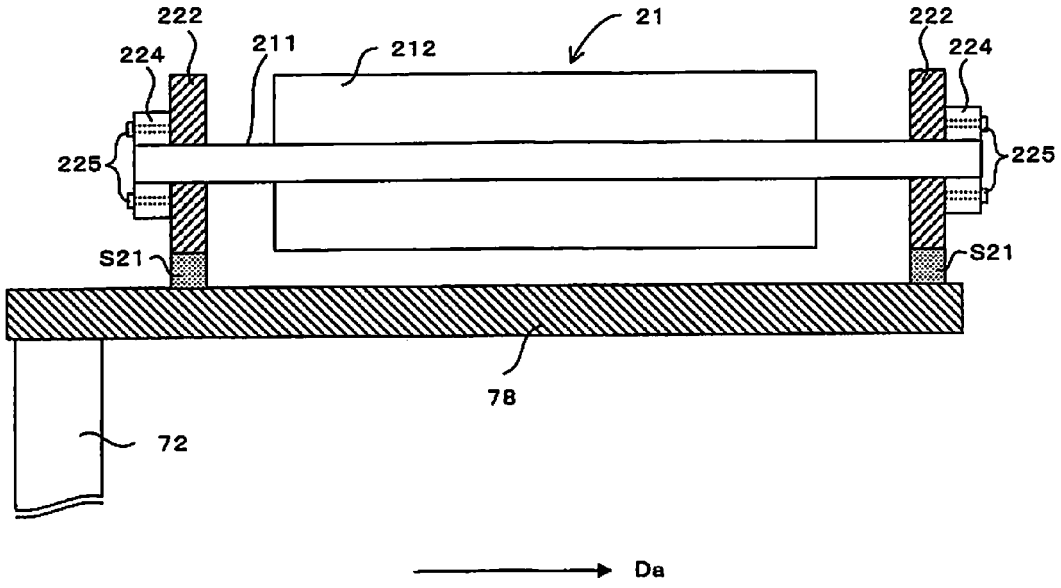
FIG. 12 is a schematic diagram illustrating a portion of a modification example 2 for the peripheral configuration of the driven roller.

The configuration of the driven roller 21 can also be modified as is illustrated in FIG. 12. FIG. 12 is a schematic diagram illustrating a portion of a modification example 2 for the peripheral configuration of the driven roller 21. Here, the description centers on the points of difference with the embodiment described above, and points in common with the embodiment described above are assigned the corresponding reference numerals and are omitted from the description. This modification example 2 differs from the embodiment described above in that the tension sensor S21 is fixed not to the main body frame 1F but instead to the roller fixation member 78 connected to the support plate 72, and in that the roller shaft 211 is fixed immovably in the axial direction Da to the holder 222, and the cylindrical member 212 rotates relative to the roller shaft 211, both ends of which are fixed with a screw 225 via set collars 224. The leaf spring 722 and the linear bushing 221, which in the embodiment above were provided to the upper end of the support plate 72, are eliminated in this modification example 2. In the modification example 2 thus configured, as well, it becomes possible to accurately detect the tension of the sheet Son the basis of the force received from the sheet S by the driven roller 21, while also configuring the driven roller 21 so as to be movable in the axial direction Da, similarly with respect to the modification example 1.

In the modification examples above, the roller fixation member 78 corresponds to one example of the "fixation member" of the invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image recording apparatus, comprising:

a roller configured to rotate in a direction of conveyance of a recording medium in a state of contact with the recording medium that is being conveyed, the roller having a support shaft extending in a direction intersecting with the direction of conveyance;

a fixation member fixing the roller movably in the direction intersecting with the direction of conveyance;

a detector positioned between the roller and the fixation member, the detector configured to detect a force received from the recording medium via the roller;

a support member having an elastic member; and a roller movement unit connected to the support member, the roller movement unit being configured to move the roller in the direction intersecting with the direction of conveyance.

2. The image recording apparatus as set forth in claim 1, wherein the support member has a fixed plate and the elastic member that is fixed to the fixed plate, and the elastic member has a smaller spring constant than the fixed plate.

3. The image recording apparatus as set forth in claim 1, wherein the detector has a strain body that is configured to deform elastically at a first spring constant in accordance with the force received from the roller, and detect the force received from the recording medium via the roller based on an amount of deformation of the strain body, and the elastic member has an elasticity of elastic deformation at a second spring constant that is smaller than the first spring constant and greater than zero.

4. The image recording apparatus as set forth in claim 3, wherein the second spring constant is equal to or lower than 1% of the first spring constant.

5. The image recording apparatus as set forth in claim 3, wherein the second spring constant is equal to or lower than 25 N/mm, and greater than 0 N/mm.

6. The image recording apparatus as set forth in claim 1, wherein the elastic member has a spring constant that is greater than the second spring constant in the direction intersecting with the direction of conveyance.

7. The image recording apparatus as set forth in claim 1, wherein the roller has a rotating member that is configured to rotate about the support shaft as a rotating shaft and move in the direction intersecting with the direction of conveyance along with the support shaft, the rotating member contacts the recording medium that is being conveyed, the fixation member supports the support shaft via the detector, and the support member is fitted to the support shaft via the elastic member.

8. An image recording apparatus, comprising:

a roller configured to contact a recording medium and rotate in a direction of conveyance of the recording medium, the roller having a support shaft extending in a direction intersecting with the direction of conveyance;

a detector configured to detect a force received from the recording medium via the roller;

a fixation member fixing the roller movably in the direction intersecting with the direction of conveyance, via the detector;

a support member connected to the fixation member; and a roller movement mechanism connected to the support member, the roller movement mechanism being configured to move the roller in the direction intersecting with the direction of conveyance.

* * * * *